US006923689B2

(12) United States Patent
Xue et al.

(10) Patent No.: US 6,923,689 B2
(45) Date of Patent: Aug. 2, 2005

(54) MODULAR JACK CONNECTOR

(75) Inventors: Yalei Xue, Kunsan (CN); Zhi-Qiang Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/946,446

(22) Filed: Sep. 20, 2004

(65) Prior Publication Data

US 2005/0064747 A1 Mar. 24, 2005

(30) Foreign Application Priority Data

Sep. 19, 2003 (TW) ..... 92216895 U

(51) Int. Cl.[7] ..... H01R 24/00
(52) U.S. Cl. ..... 439/676; 439/490; 439/607
(58) Field of Search ..... 439/607, 676, 439/490

(56) References Cited

U.S. PATENT DOCUMENTS 4,202,593 A * 5/1980 Abernethy et al. ..... 439/569
4,698,025 A * 10/1987 Silbernagel et al. ..... 439/79
4,703,991 A * 11/1987 Philippson ..... 439/676
4,786,259 A * 11/1988 Paul ..... 439/344
4,817,283 A * 4/1989 Johnston et al. ..... 29/884
4,968,025 A * 11/1990 Edkins ..... 482/23
5,397,250 A 3/1995 Briones
5,456,619 A 10/1995 Belopolsky et al.
5,599,209 A * 2/1997 Belopolsky ..... 439/676
5,759,070 A * 6/1998 Belopolsky ..... 439/676
6,171,153 B1 * 1/2001 Belopolsky ..... 439/701
6,238,244 B1 * 5/2001 Yang ..... 439/607
6,257,935 B1 * 7/2001 Zhang et al. ..... 439/680
6,283,796 B1 * 9/2001 Yeh ..... 439/677
6,296,527 B1 * 10/2001 Zhang et al. ..... 439/676
6,302,741 B1 * 10/2001 Fasold et al. ..... 439/620
6,474,999 B1 * 11/2002 Givens et al. ..... 439/76.1
6,786,772 B1 * 9/2004 Liu ..... 439/620
6,793,538 B2 * 9/2004 Huang ..... 439/676
6,811,442 B1 * 11/2004 Lien et al. ..... 439/620
6,811,446 B1 * 11/2004 Chang ..... 439/676

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector (100) mounted on a printed circuit board includes an insulative housing (2) and a terminal module (3) received in the housing. The insulative housing (2) defines a receiving cavity (24) for receiving a mating electrical connector and a top plate (22) with a cutout (221). The terminal module is received in the insulative housing and comprises a dielectric body (30) and a plurality of conductive terminals (31) fixed in the body. Each conductive terminal includes a contact portion (312) for electrically connecting with the mating electrical connector and a fixing portion fixed in the dielectric body. The dielectric body comprises a substantially horizontal portion (301) for engaging with the cutout of the insulative housing and a mating recess (303) positioned on a front edge of the horizontal portion, thereby forming a ladder-shaped front portion thereof, with the fixing portion of the conductive terminal positioned in a bottom portion of the horizontal portion.

4 Claims, 5 Drawing Sheets

MODULAR JACK CONNECTOR

BACKGROUND OF THE INVENTION

1. Field of the Invention

The present invention relates to an electrical connector and more particularly, to a modular jack.

2. Description of the Prior Art

Modular jack connectors are commonly used in the computers or network appliances as input/output ports for transmitting data or signals. An example of such a connector is disclosed in U.S. Pat. No. 5,456,619 on Oct. 10, 1995 which describes a modular jack assembly. The conventional modular jack assembly includes an insulative housing and a terminal module received in the housing and an out shell surrounding the housing. Said insulative housing defines a front receiving room for receiving a mating electrical connector and a rear receiving cavity for receiving said terminal module. The housing defines a cutout through a top wall thereof. Said terminal module includes a dielectric base and a plurality of conductive terminals assembled in the base. The base of the terminal module comprises a pair of horizontal flanges positioning on two sides thereof. The insulative housing defines a pair of horizontal grooves for engaging the flanges of the terminal module, thereby mounting the terminal module in the insulative housing. The base defines a plurality of upwardly exposed passageways for receiving the conductive terminals. However, because the housing has the cutout in the top wall thereof, a top surface of the terminal module is not completely surrounded by the insulative housing. The conductive terminals are exposed to the out shell. Undesired electrical connections between the terminals and the out shell tend t occur resulting in short circuit between the out shell and the terminal module under a high voltage and further influencing signal transmission and even damaging the electrical connector. Engaging the horizontal flanges of the terminal module with the horizontal grooves of the housing can not securely retain the terminal module in the housing, thereby further decreasing the electric capability of the modular jack.

Hence, an improved electrical connector is desired to overcome the foregoing shortcomings.

BRIEF SUMMARY OF THE INVENTION

A main object of the present invention is to provide an electrical connector to be able to bear high voltage and having a good electric capability.

An electrical connector mounted on a printed circuit board includes an insulative housing and a terminal module received in the housing. The insulative housing defines a receiving cavity for receiving a mating electrical connector (not shown) and a top plate with a cutout. The terminal module is received in the insulative housing and comprises a dielectric body and a plurality of conductive terminals fixed in the body. Each conductive terminal includes a contact portion for electrically connecting with the mating electrical connector and a fixing portion fixed in the dielectric body. The dielectric body comprises a substantially horizontal portion for engaging with the cutout of the insulative housing and a mating recess positioned on a front edge of the horizontal portion, thereby forming a ladder-shaped front portion thereof, with the fixing portion of the conductive terminal positioned in a bottom portion of the horizontal portion.

Comparing to prior arts, the terminal module includes the horizontal portion and the mating recess in the front edge of the horizontal portion, thereby forming the ladder-shaped front portion thereof. The insulative housing adopts an inclined plane for engaging with the mating recess of the horizontal portion, thereby securely mounting the terminal module in the insulative housing and increasing the electric capability of the electrical connector. In addition, the ladder-shaped front portion adopted in the present invention increases a distance among the conductive terminals and the top wall of the outer shell and ensures the conductive terminals and the outer shell of the electrical connector not be damaged on a high voltage, therefore, the electrical connector is able to bear high voltage.

Other objects, advantages and novel features of the invention will become more apparent from the following detailed description when taken in conjunction with the accompanying drawings.

DETAILED DESCRIPTION OF THE INVENTION

Figure 1:
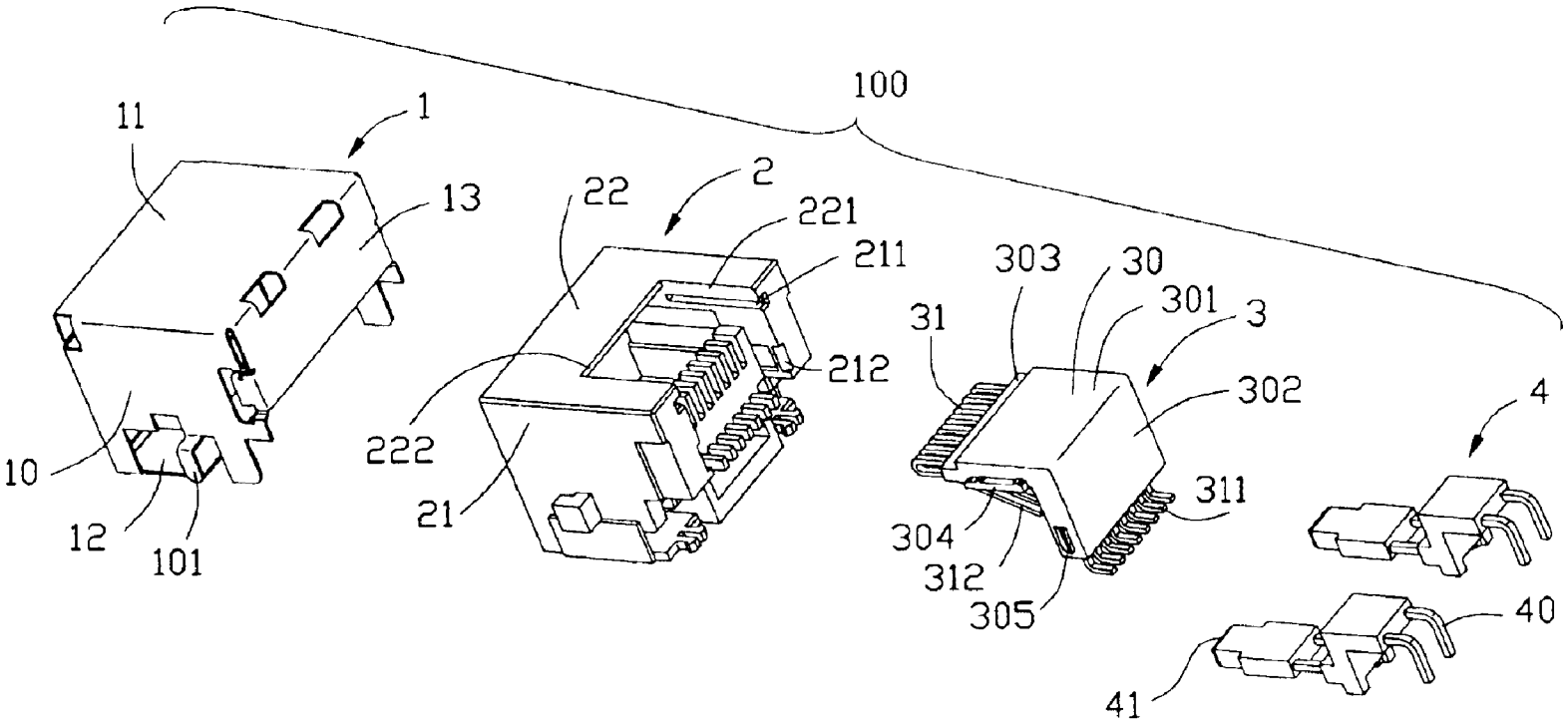
FIG. 1 is an exploded view of an electrical connector according to the present invention.
Figure 2:
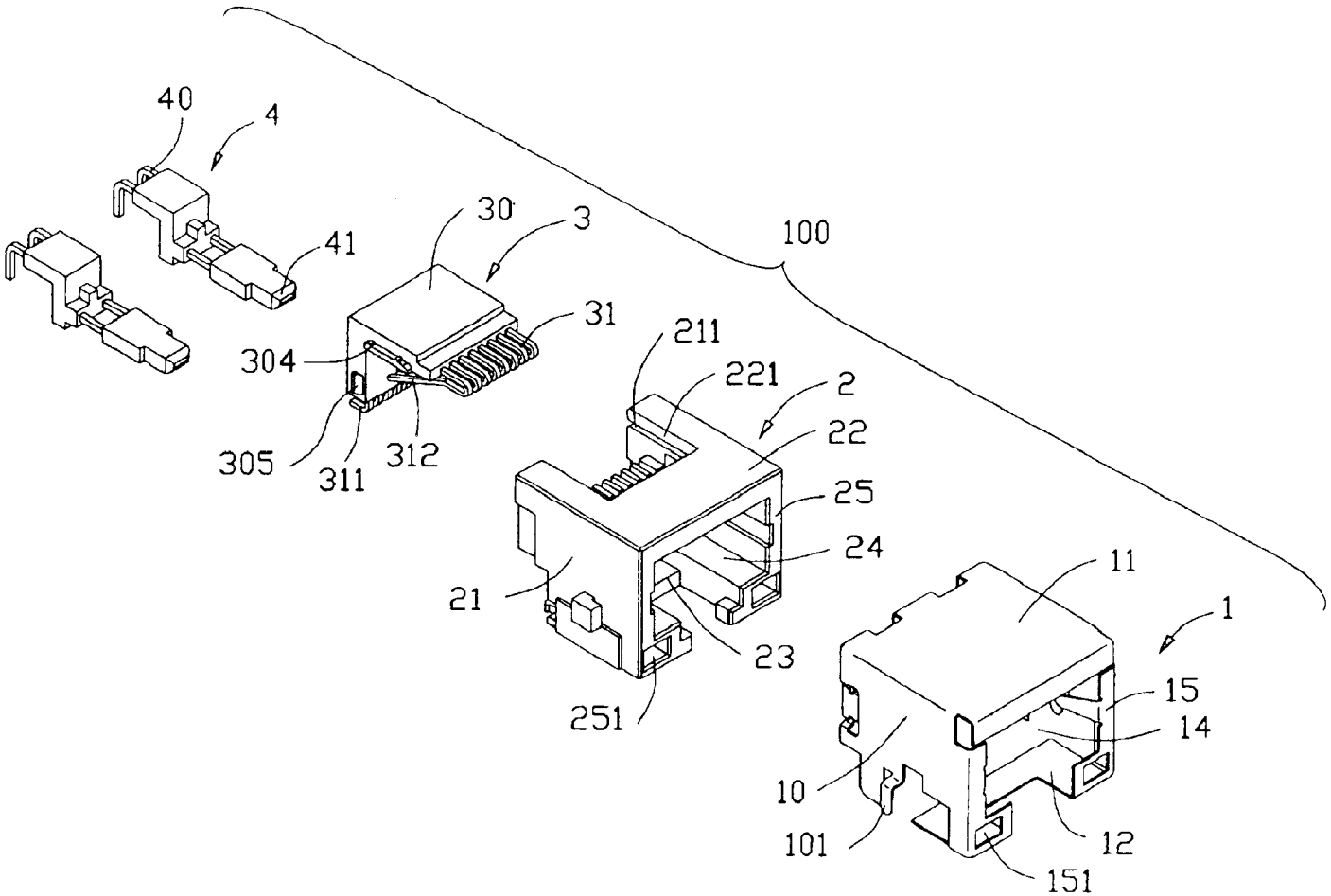
FIG. 2 is another exploded view of the electrical connector.
Figure 3:
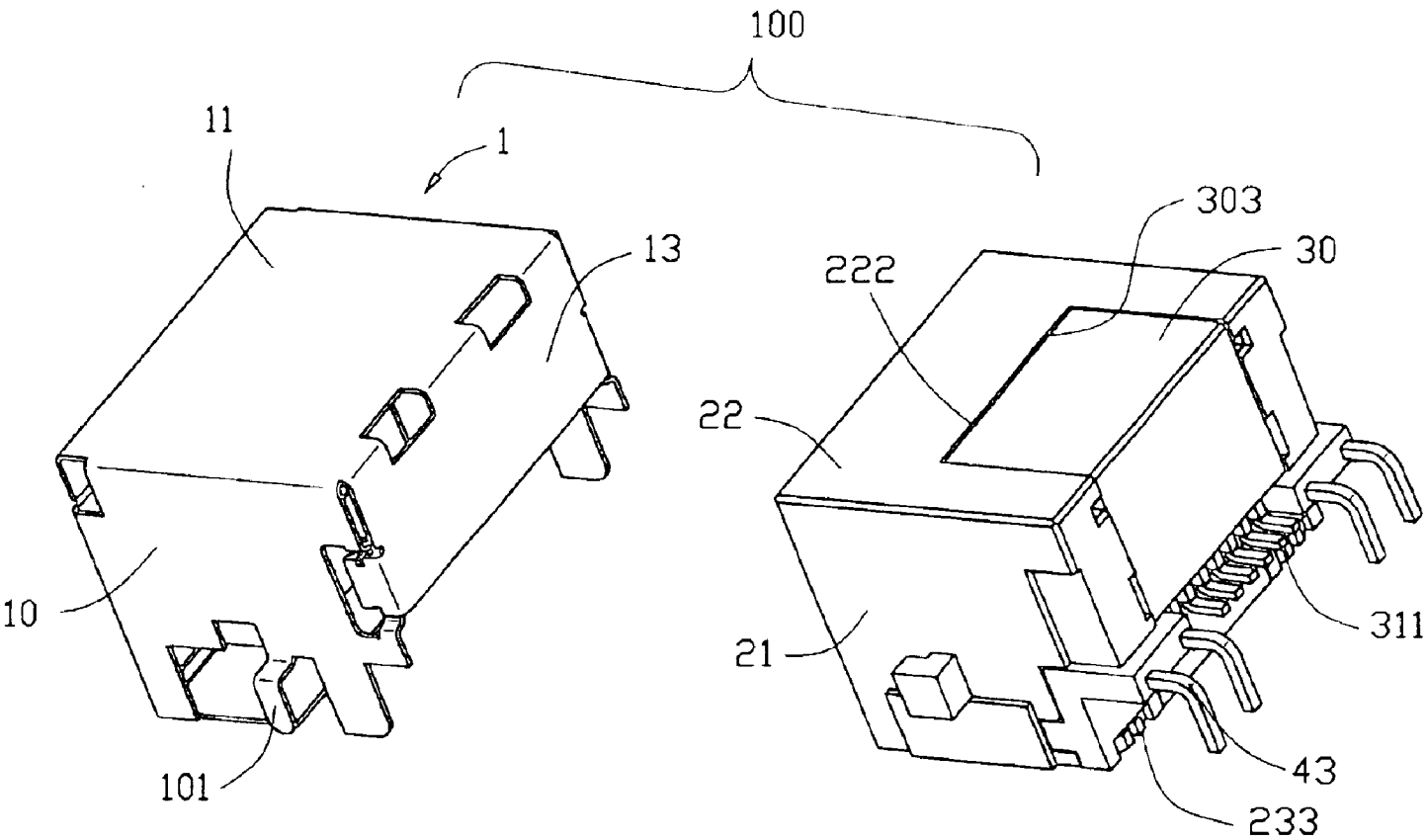
FIG. 3 is a partially assembled view of the electrical connector of FIG. 1.
Figure 4:
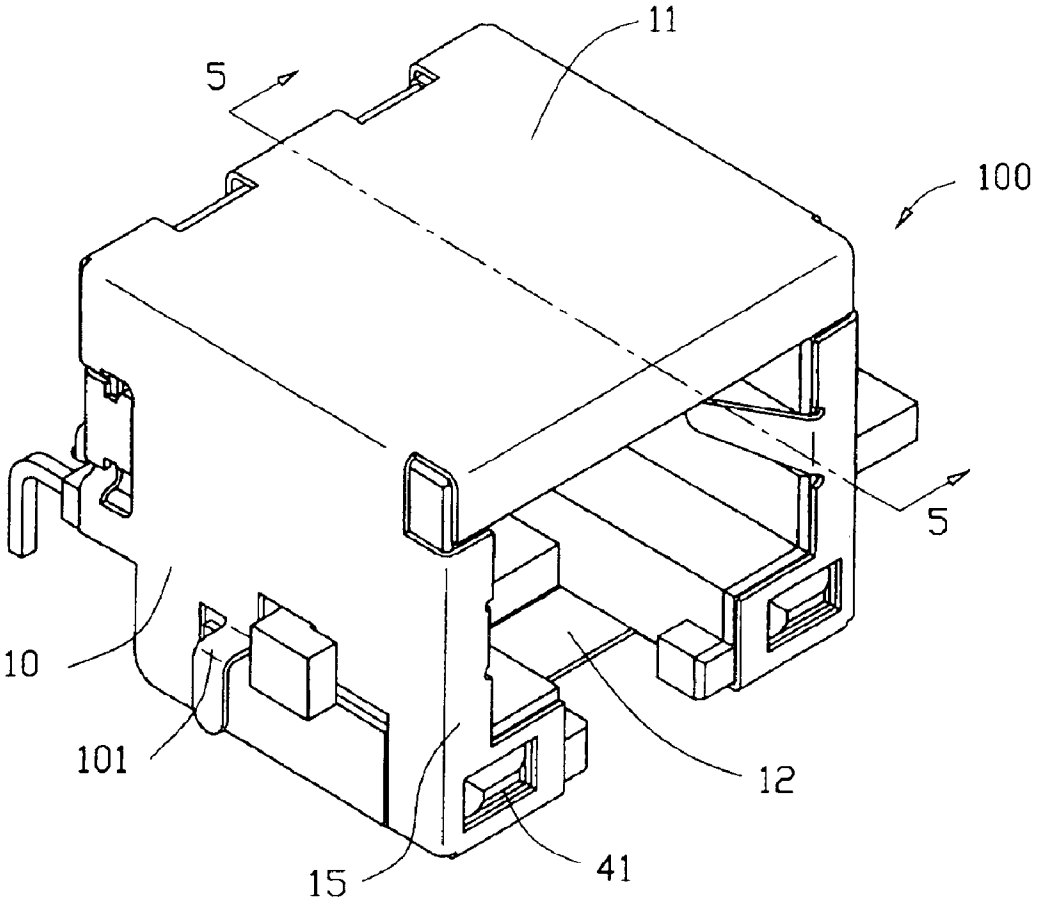
FIG. 4 is an assembled view of the electrical connector of FIG. 2.

Referring to FIGS. 1–2, an electrical connector 100 according to the present invention mounted on a printed circuit board (not shown) includes an outer shell 1, an insulative housing 2 substantially surrounded and shielded by said shell 1, a terminal module 3 and a pair of Light Emitting Diodes (LEDs).

The outer shell 1 includes a pair of side walls 10, a top wall 11, a bottom wall 12 opposite to the top wall 11, a rear wall 13 and a front mating wall 15. A receiving room 14 is defined by the above walls 10, 11, 12, 13 and 15. A pair of openings 151 are defined through opposite side portions of a lower portion of the mating wall 15. A pair of retaining legs 101 downwardly extend from corresponding bottom portions of corresponding side walls 10 to mount the electrical connector 100 to the printed circuit board.

Figure 5:
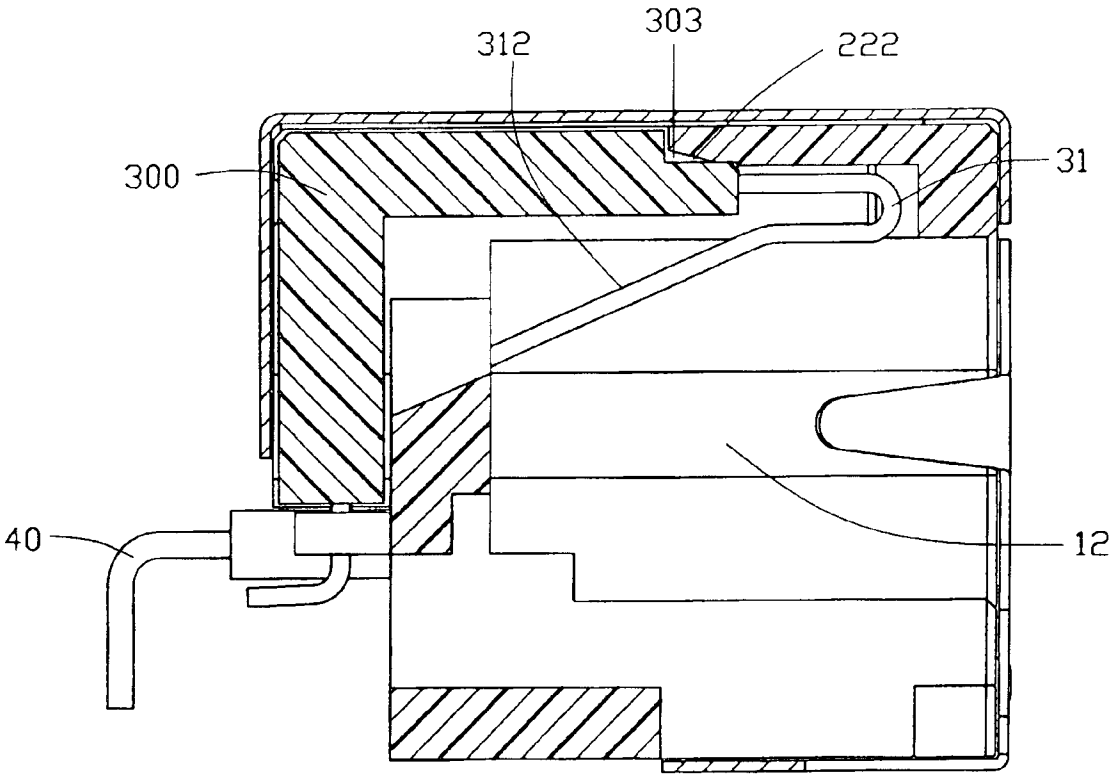
FIG. 5 is a cross sectional view taken along from line 5—5 of FIG. 4.

The insulative housing 2 includes a pair of side plates 21, a top plate 22, a bottom plate 23 and a front mating plate 25. A receiving cavity 24 is defined by the above plates 21, 22, 23 and 25 for receiving a mating electrical connector. A pair of holes 251 are defined through opposite side portions of a lower portion of the insulative housing 2. Each side plate 21 defines a groove 211 in an upper portion of an inner surface thereof extending into a rear surface (not labeled) of the housing 1 along an insertion direction of the mating electrical connector. Each side plate 21 defines a fixing recess 212 in a rear portion of the inner surface thereof. The housing 2 defines a cutout 221 through a rear portion of the top plate 22 thereof for engaging with the terminal module 3. The top plate 22 comprises an inclined plane 222 in an inner surface of the rear portion (shown in FIG. 5) thereof.

The terminal module 3 includes a substantially L-shaped dielectric body 30 and a plurality of conductive terminals 31 received in the dielectric body 30. The dielectric body 30 is formed of a molded one-piece plastic material and comprises a horizontal portion 301 and a vertical portion 302. The horizontal portion 301 has a mating recess 303 in a front edge thereof for engaging with the inclined plane 222 of the gap 221 of the top plate 22 of the insulative housing 2. A pair of hook flanges 304 project outwardly from two sides of the horizontal portion 301 for engaging with the grooves 211 of the insulative housing 2. A pair of lock portions 305 project from two sides of the vertical portion 302 for engaging with the fixing recesses 212 of the insulative housing 2. Each conductive terminal 31 includes a middle L-shaped fixing portion (not shown) fixed in the housing 30, a front contact portion 312 for electrically connecting with the mating electrical connector and a rearwardly extending soldering portion 311. The rearwardly extending soldering portion 311 is substantially perpendicular to the vertical portion 302 for soldering the electrical connector 100 to the printed circuit board. The fixing portion of each conductive terminal 31 comprises a horizontal section positioned in a lower portion (not labeled) under the mating recess 303 of the horizontal portion 31.

Each LED 4 includes a front light section 41 received in the holes 251 of the insulative housing 2 and a tail portion 40 for electrically connecting with the printed circuit board.

Referring to FIGS. 1–5, in assembly, firstly, the terminal module 3 is assembled in the insulative housing 2. The mating recess 303 of the horizontal portion 301 of the housing 30 engage with the inclined plane 222 of the rear portion of the top plate 22 of the housing 2. The hook flanges 304 on the horizontal portion 301 engage with corresponding grooves 211 of the side plate 21 of the housing 2. The lock portions 305 on the vertical portion 302 lock with corresponding fixing recesses 212 of the side plate 21 of the housing 2, thereby securely fixing the terminal module 3 into the insulative housing 2. The contact portion 312 of the conductive terminal 31 is received in the receiving cavity 24 of the insulative housing 2. Secondly, the LEDs 4 are inserted into the insulative housing 2 through the holes 251 of the housing 2. Finally, the outer shell 1 shields the insulative housing 2. The openings 151 of the front mating wall 15 of the out shell 1 are corresponding to the holes 251 of the front mating plate 25 of the insulative housing 2. The front light section 41 of the LED 4 appears in the opening 151 of the out shell 1. The retaining legs 101 of the out shell 1 are fixed by the printed circuit board, thereby securely mounting the electrical connector 100 on the printed circuit board. The soldering portions 311 of the conductive terminals 31 and the tail portion 40 of the LED 4 respectively electrically connect with corresponding electrical traces (not shown) of the printed circuit board, thereby establishing an electrical connecting between the electrical connector 100 and the printed circuit board.

In the preferred embodiment of the present invention, the terminal module 3 adopts the mating recess 303, and the insulative housing 2 adopts the inclined plane 222 for engaging with the mating recess 303 of the horizontal portion 301, thereby securely holding the terminal module 3 in the insulative housing 2 and increasing the electric capability of the electrical connector 100. In addition, positioning the conductive terminals 31 in the lower portion of the horizontal portion under the mating recess 303 increases a distance between the conductive terminals 31 and the top wall 11 of the outer shell 1 and ensures the conductive terminals 31 and the outer shell 1 of the electrical connector not be damaged on a high voltage, therefore, the electrical connector 100 is able to bear high voltage.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mounting on a printed circuit board comprising:

an insulative housing defining a receiving cavity for receiving a mating electrical connector and a top plate, the top plate defining a cutout communicating with the receiving cavity and a rear portion exposed to the cutout;

a terminal module received in the insulative housing and comprising a dielectric body and a plurality of conductive terminals fixed in the body, each conductive terminal including a contact portion for electrically connecting with the mating electrical connector and a fixing portion fixed in the dielectric body, the body comprising a substantially horizontal portion for mating with the cutout of the insulative housing, the horizontal portion defining a mating recess in a front section thereof;

wherein the rear portion of the top plate of the insulative housing includes an inclined plane for facilitating mating with the mating recess of the terminal module;

wherein the horizontal portion of the body has a lower portion under the mating recess, and wherein the conductive terminals being fixed in the lower portion;

wherein the side plate defines a fixing recess in the inner surface thereof, and wherein the body of the terminal module includes a vertical portion extending from the horizontal portion, a lock portions project from side of vertical portion thereof for the fixing with the recess.

2. The electrical connector according to claim 1, wherein the insulative housing includes a side plate, and wherein said side plate defines a groove in an inner surface thereof extending into a rear surface of the housing along an insertion direction of the mating electrical connector, and wherein the terminal module includes a hook flange for mating with said groove of the insulative housing.

3. The electrical connector according to claim 1, wherein said electrical connector includes a Light Emitting Diode, and wherein said Light Emitting Diode includes a front light portion and a tail portion for electrically connecting with the printed circuit board.

4. An electrical connector adapted for mounting on a printed circuit board and mating with a mating connector, comprising:

an insulative housing defining a receiving cavity for receiving the mating electrical connector and a top plate defining a cutout communicating with the receiving cavity, the top plate comprising an inclined plane in an inner surface of a rear portion thereof;

a terminal module received in the insulative housing and comprising a dielectric body and a plurality of conductive terminals fixed in the body, each conductive terminal including a contact portion for electrically connecting with the mating electrical connector and a fixing portion fixed in the dielectric body, the body comprising a substantially horizontal portion for mating with the cutout of the dielectric body, the horizontal portion defining a mating recess in a front section thereof, the fixing portion positioning in a lower portion of the horizontal portion under the mating recess;

wherein the insulative housing includes a side plate, and wherein the side plate defines a groove in an inner surface thereof extending into a rear surface of the housing along an insertion direction of the mating electrical connector, and wherein the terminal module includes a hook flange for mating with the groove of the insulative housing; and wherein each side plate defines a fixing recess in the inner surface thereof, and wherein the housing of the terminal module includes a vertical portion extending from the horizontal portion, a lock portion project from side of the vertical portion thereof for fixing with the recess.

* * * * *